US010840039B2

(12) United States Patent
Cartapatti

(10) Patent No.: US 10,840,039 B2
(45) Date of Patent: Nov. 17, 2020

(54) SWITCH DEVICE FOR AN IGNITION SYSTEM

(71) Applicant: ILLINOIS TOOL WORKS INC., Glenview, IL (US)

(72) Inventor: Flavio Luis Cartapatti, Sao Paulo (BR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 14/890,992

(22) PCT Filed: Apr. 8, 2014

(86) PCT No.: PCT/US2014/033353

§ 371 (c)(1),
(2) Date: Nov. 13, 2015

(87) PCT Pub. No.: WO2014/189621

PCT Pub. Date: Nov. 27, 2014

(65) Prior Publication Data

US 2016/0111235 A1 Apr. 21, 2016

(30) Foreign Application Priority Data

May 20, 2013 (BR) ..... 1020130124494

(51) Int. Cl.
*H01H 19/04* (2006.01)
*H01H 1/36* (2006.01)
(Continued)

(52) U.S. Cl.
CPC ..... *H01H 19/04* (2013.01); *F24C 3/103* (2013.01); *H01H 1/36* (2013.01); *H01H 19/14* (2013.01);
(Continued)

(58) Field of Classification Search
CPC ..... H01H 1/06; H01H 19/14; H01H 1/2041; H01H 19/62; H01H 13/58; H01H 1/58;
(Continued)

(56) References Cited

U.S. PATENT DOCUMENTS 3,971,904 A 7/1976 Ward
4,107,482 A 8/1978 Marker
(Continued)

FOREIGN PATENT DOCUMENTS

CN 1282086 A 1/2001
DE 4447165 A1 7/1996

OTHER PUBLICATIONS

ISR and WO for PCT/US2014/033353 mailed Aug. 5, 2014.

*Primary Examiner* — Ahmed M Saeed
(74) *Attorney, Agent, or Firm* — Pilloff Passino & Cosenza LLP; Martin J. Cosenza

(57) ABSTRACT

The present invention relates to a switch device for ignition systems and, more particularly, for use in cooking equipment or heating systems in general, such as to obtain the electrical contact necessary to generate the spark for activating the burner. More preferably, the present invention includes innovative functional and technical aspects capable of promoting the electrical contact necessary to activate the burner, but principally to increase the levels of safety in relation to movement of the controls of cooking equipment/heating equipment, principally in connection with the return movement of said control. Therefore, the present switch device comprises a casing formed by a lower structural body and another, upper structural body, which engage with one another in such a manner as to accommodate, within, flexible contact blades and a rotary core, the structural bodies having contact surfaces provided with at least one
(Continued)

projecting portion; furthermore, an axially moveable commutator ring is engaged on said rotary core.

23 Claims, 8 Drawing Sheets

(51) Int. Cl.
*H01H 19/62* (2006.01)
*F24C 3/10* (2006.01)
*H01H 19/14* (2006.01)

(52) U.S. Cl.
CPC ..... *H01H 19/62* (2013.01); *H01H 2201/022* (2013.01); *H01H 2231/012* (2013.01)

(58) Field of Classification Search
CPC ..... H01H 21/38; H01H 21/50; H01H 3/42; H01H 5/06; H01H 9/0038; H01H 9/042; H01H 15/102; H01H 19/06; H01H 19/635; H01H 1/5844; H01H 1/62; H01H 2011/067
USPC ..... 200/275, 565, 11 G, 11 R, 568, 1 R, 200/16 A, 17 R, 238, 38 B, 402, 446, 5 R, 200/51 R, 51.1, 535, 570, 6 BB, 61.58 R
See application file for complete search history.

(56) References Cited

U.S. PATENT DOCUMENTS 4,463,231 A * 7/1984 Cooper ..... H01H 13/58 200/528
4,506,124 A * 3/1985 Rose ..... H01H 13/58 200/528
4,861,949 A * 8/1989 Bortolloni ..... H01H 19/03 200/5 R
5,967,304 A * 10/1999 MacKay ..... H01H 19/56 200/11 R
2005/0150749 A1* 7/2005 Lung ..... H01H 25/008 200/4
2011/0315531 A1* 12/2011 Wong ..... H01H 3/50 200/293

* cited by examiner

SWITCH DEVICE FOR AN IGNITION SYSTEM

RELATED APPLICATIONS

The present application is a National Phase of International Application Number PCT/US2014/033353 filed Apr. 8, 2014 and claims priority to Brazilian Application Number 10 2013 012449 4 filed Feb. May 20, 2013.

FIELD OF THE INVENTION

The present invention relates to a switch device for an ignition system, developed in particular for use in domestic electrical appliances and, more particularly, for installation in cooking equipment and heating systems, where there is a need to promote the electrical contact in order to generate the spark for activating the burner.

More preferably, the rotary switch device that is the subject of the present invention includes innovative functional and technical aspects capable of promoting the electrical contact necessary to activate the burner, but principally to increase the levels of safety in relation to movement of the activation and fuel-release controls on cooking equipment and/or heating systems in general (such as boilers), principally in connection with the return movement of said control.

BACKGROUND OF THE INVENTION

As should be general knowledge on the part of persons skilled in the art, gas cooking equipment or heating systems include burners where flames are generated for heating cooking utensils or fluid-conducting pipes. To that end, it is known that said burners are connected to fuel-supply conduits and, furthermore, have an electrically activated ignition element to generate a spark in the vicinity of each burner, consequently forming the flame.

Currently, it is observed that there is a very wide variety of models of cooking equipment and heating systems with a boiler, and these offer a broad range of options and accessories and also various mechanisms aimed at enhancing the practical nature, ergonomics and safety levels of such equipment during operation. Thus, it may be stated that there are equipment models in which activation of the burners is totally dependent on an external igniter, e.g. a match or lighter, but it is also known that there are other models in which activation is incorporated into the equipment, that is to say by a button specially for this use, such as in those cases in which the control itself is responsible for promoting the electrical contact and subsequent generation of the spark in the burner.

The present invention relates particularly to those models of cooking equipment or heating systems in which spark generation is promoted by the rotational movement of the controls, i.e. when the user turns the control, the flow of fuel is released and then an electrical contact is closed in order to activate the ignition element provided in the vicinity of the burner.

Therefore, as a general rule, models of controls known in the prior art comprise a switch device that is in some way coupled to the structure of the control in order to be activated at the time when said control is turned by the user.

Among the models that are known and available on the market, it is noted that, in the vast majority, this switch device is a component formed by a structure in which flexible contact blades are provided which move in accordance with the activation of a rotary core that engages with the activation shaft of the fuel valve, which is, also, normally, the same shaft as that with which the control of the equipment engages. Said flexible contact blades are, respectively, connected to the electrical circuit of the cooking equipment or heating system by means of wires in such a manner as to connect the electrical power source and the ignition elements of each burner. In practice, it is observed that said switch device is installed in internal portions in the equipment panel, i.e. hidden from users' view.

The switch devices currently manufactured and marketed by the actual applicant and also by other manufacturers include a supporting structure where the flexible contact blades are positioned, and the rotary core is provided with a peripheral projection, e.g. a cam system. Thus, by virtue of the rotational movement of the control and consequently of the rotary core of the switch device, this peripheral projection acts on the flexible contact blades, causing them to lie against one another, thereby activating the burner ignition element.

As is known by persons skilled in the art, these contact blades are connected to the ignition elements and to the electrical circuit of the cooking/heating equipment by means of electric cables or another, equivalent means. There are also models currently marketed in which blades are interlinked in series via a cord, which facilitates the assembly process on cooking/heating equipment production lines.

Despite having hitherto being very functional, it has been noted that this switch device available on the market presented a technical drawback connected with the movement of the control in the opposite direction for closing the valve and turning off the burners. More specifically, it was observed, at the time when the control was rotated in the turn-off direction, that said projection provided on the surface of the rotary core gave rise to movement of the flexible contact blades and consequently gave rise to a new electrical contact between them, which resulted in the generation of a possible "return spark", i.e. although the user was returning the control to the off position, this movement can give rise to a new spark in the burners.

Therefore it has been observed that movement of said rotary core of the switch device generates a spark at the time when the burner was activated and also at the time when the burner was turned off, i.e. independently of the direction of rotation of the control, the ignition elements were activated and gave rise to sparks.

As it must be appreciated by persons skilled in the art, this "return spark" is not viewed very positively by manufacturers of cooking and heating equipment since, despite appearing to be innocuous, there is a concern that, should the burner flame be turned off and the burner continue to release fuel, when the user returns the control to the closed position, intending to simply to close the fuel valve, generation of this "return spark" will occur and possibly may give rise to an accident, principally if the equipment has no safety devices to prevent the flow of fuel in the absence of a flame.

In theory, if the burner flame goes out unintentionally and fuel continues to be released by the burner for a very long period, there would be a risk that, when the user returns the control to the closed position, said projection of the rotary core would give rise to movement of the flexible contact blades and consequently would generate the "return spark". Thus, in such a situation, there is an, albeit small, risk of some type of accident being caused.

Therefore, it was seen to be necessary to produce switch devices designed particularly for the ignition system of gas cooking equipment and heating systems, whereby the operation thereof does not give rise to so-called "return sparks" when the user moves the control in the turn-off direction. More particularly, manufacturers of switch devices went on to attempt to develop solutions capable of eliminating this potential cause of accidents.

In trying to resolve this drawback, a switch device is known on the market in which the construction seeks to promote the elimination of this "return spark", i.e. the prior art device model attempts to provide a solution that prevents the generation of sparks when the user returns the control to the off position. However, it is noted that this solution requires a relatively complex structure that is difficult to set up, principally on lines for the manufacture and assembly of such components.

More specifically, this switch design model known in the prior art comprises a rotary core in which the external wall surface also has a projection in order to form a cam-type system. However, in this case, the configuration of this projection is designed to act on a small intermediate part responsible for the movement of the flexible contact blades. In accordance with this solution, the small intermediate part is a kind of latch that, in the direction of activation of the burner, is rotated on its supporting shaft in such a manner to activate and contact the flexible contact blades, and in the opposite direction said latch performs an axial movement in relation to its supporting shaft such that it is shifted in relation to the positioning of the flexible contact blades, thereby preventing the generation of the "return spark" when the control of the equipment is moved to the turned-off position.

More specifically, it is noted that said latch and said rotary core have a configuration designed such that, in the course of the burner activation movement, the projection provided on the rotary core is capable of pushing the latch aside such that it performs a rotational movement in relation to its supporting shaft. Furthermore, said projection, on its opposite side, comprises a configuration in the form of a ramp that, upon entering into contact with said latch, causes the latter to be shifted axially in relation to its supporting shaft, such that said latch is out of alignment with the contact blades and consequently there will be no contact between the blades and logically no generation of a spark during the return movement of the control to the turned-off position.

Despite solving the drawbacks of prior art switch devices in part, this model still suffered from restrictions and problems, e.g. said latch is a very small element and requires precise configuration which is adapted to the rotary core projection. More specifically, it is noted that the process for the manufacture of this small latch requires machinery and skilled staff capable of producing and, moreover, handling such components very carefully during the switch device assembly stages.

Another drawback commonly observed with this type of switch device relates to the fragility of this small latch, since it has a small, fragile structure, with relatively thin, delicate segments, which, depending on the roughness with which the user handles it, it will undoubtedly result in these small intermediate parts being damaged, and consequently there is a risk of damaging the burner ignition system, particularly on account of the fragility of the parts involved in this type of solution. Furthermore, it is noted that, by virtue of this part having a very delicate configuration, it is possible that during its manufacturing process some types of burr may be left on the surface and, by virtue of such burrs, there is a risk of causing the switch device to jam.

Therefore, in view of the foregoing, it is observed that prior art cooking and heating equipment requires switch devices capable of eliminating small risks and drawbacks that might give rise to accidents, even if it is small. More specifically, it is noted that there is a need to develop switch devices for burner ignition systems of cooking appliances and heating systems which are capable of generating activation sparks only when it is desired to activate the burners, but which principally do not generate any return sparks when the equipment control moves to the turned-off position.

OBJECTS OF THE INVENTION

It is therefore an object of the present invention to provide a switch device to be coupled to controls for activating and controlling burners, particularly designed for heating systems in general. More specifically, the switch device according to the present invention includes technical and functional features developed in order to simply, efficiently and economically address the limitations and drawbacks exhibited by ignition systems known in the prior art.

More preferably, an object of the present invention is to propose a rotary switch device for use in ignition systems of cooking equipment and heating systems, comprising technical and functional features capable of safely and efficiently eliminating the so-called "return sparks", which commonly occur when the control is moved to the turned-off position.

Furthermore, it is an object of the present invention to provide a switch device comprising robust technical aspects that eliminate any risk of breakage, damage or jamming that might compromise proper functioning of the ignition system for cooking and heating equipment.

A further object of the present invention is to propose a switch device that has a simplified configuration but which is capable of correctly and precisely positioning the elements responsible for activation of the flexible contact blades and consequently the electrical contact for generating the ignition sparks.

In addition, a further object of the present invention is to provide a rotary switch device for ignition systems for burners of cooking equipment and heating systems in general that has a configuration capable of considerably simplifying the manufacturing and assembly process, not only of the switch device but also of the cooking and heating equipment generally.

Therefore, in brief, the main object of the present invention is to propose a rotary switch device for ignition systems of cooking and heating equipment, designed to eliminate the risks of causing sparks when the user moves the control to the turned-off position and also to provide a configuration that is simple and easy to manufacture and assemble on production lines.

SUMMARY OF THE INVENTION

Thus, in order to achieving the objects and technical effects mentioned above, the present invention relates to a switch device used in particular in ignition systems and more preferably in domestic electrical appliances of the cooking or heating type in general, said device being formed by a casing constituted by at least two structural bodies, i.e. a lower body and another, upper body, which engage with one another in such a manner as to accommodate, within, the flexible contact blades and a rotary core for generating sparks in burners. The upper and lower structural bodies of the device of the present invention have contact surfaces provided with at least one projecting portion, between which is arranged said rotary core that receives an axially movable commutator ring.

In accordance with a possible embodiment of the present invention, the flexible contact blades of the switch device for ignition systems are arranged in slots provided in said structural bodies, i.e. in the lower body, in the upper body, or, furthermore, in both structural bodies. Alternatively, said flexible contact blades may be embedded directly and affixed during the process of manufacturing the structural bodies, such as in the course of the injection-molding process.

According to a preferably advantageous embodiment of the present invention, the flexible contact blades are formed by two-part plates preferably in a metallic material or any other material capable of conducting electricity, one of the segments of the plate, in this case, being inserted into one of the slots arranged in the structural bodies, and the other segment of the plate being positioned so as to remain free and having elastic movement properties in accordance with activation of the commutator ring.

In a preferred embodiment of the switch device that is the subject of the present invention, said rotary core has a central aperture for the passage of the gas tap shaft and, furthermore, has rails for the engagement and sliding of guides provided in the internal portion of said commutator ring. According to an alternative embodiment, said rail may be arranged vertically or on a slant.

In addition, according to a likewise preferred embodiment of the present invention, the commutator ring of the switch device comprises at least one upper protuberant portion and at least one lower protuberant portion that interact with the respective projecting portions provided on the contact surfaces of the structural bodies. Furthermore, said commutator ring has a peripheral wall provided with at least one cam for contact with the flexible blades.

According to an embodiment that offers functional advantages, the rotary core of the device of the present invention comprises at least two rails, and the respective commutator ring also has a corresponding number of guides, thereby ensuring appropriate alignment of one component with another, principally during the sliding of said commutator ring in relation to the rotary core.

BRIEF DESCRIPTION OF THE DRAWINGS

The features, advantages and technical effects of the present invention, as indicated above, will be better understood by a person skilled in the art on the basis of the following detailed description, which is purely illustrative and non-limiting, of preferred embodiments, and with reference to the appended schematic drawings, in which.

DETAILED DESCRIPTION OF THE INVENTION

In accordance with the schematic figures mentioned above, certain preferred and possible illustrative embodiments of the present invention will be described in greater detail below, but it should be made clear that this is a purely illustrative and non-limiting description since the present switch device for ignition systems of cooking equipment and heating systems may include different details and structural and dimensional aspects without thereby departing from the respective scope of protection.

In addition, it is pointed out that certain reference signs indicating the features of the present invention will not be reproduced in all the figures mentioned above, given that reproduction of all the reference signs in all the figures could adversely affect the understanding and definition of the scope of protection in question. Furthermore, there are certain figures in which some of the components are omitted in order to make it possible adequately to view the technical aspects of the present invention.

More particularly, according to FIGS. 1 to 6, the switch device for ignition systems of domestic electrical appliances that is the subject of the present invention comprises a casing 1 constituted by at least two structural bodies, a lower structural body 1*a* and an upper structural body 1*b*, which engage with one another, the flexible contact blades L and a rotary core 2 designed to be engaged on the gas tap shaft of the cooking or heating equipment being positioned inside said structural bodies.

The lower structural body 1*a* comprises a contact surface 4*a* on which the rotary core 2 rests in a condition in which it may be moved rotationally in relation to the structural body 1*a*, said contact surface 4*a* being provided with at least one projecting portion 5*a* that interacts with a commutator ring 3 engaged movably on said rotary core 2.

According to a preferred embodiment of the present invention, and especially in connection with the practical assembly thereof, the lower structural body 1*a* is provided with slots 6 for accommodating said flexible contact blades L. Logically, as must be appreciated by persons skilled in the art, said slots 6 could also be provided in the upper structural body 1*b* or, furthermore, in both structural bodies, e.g. each body being responsible for supporting one contact blade L, since it is necessary, as a minimum requirement, at least two blades in order to obtain the closure of the electrical contact.

In a further structural variant of the present invention, said contact blades may also be embedded directly and affixed during the process of manufacturing the structural bodies 1*a* or 1*b*, principally in those cases where said structural bodies are manufactured by means of an injection-molding process, which would simplify and reduce the costs of the manufacturing process of the present invention.

Figure 6:
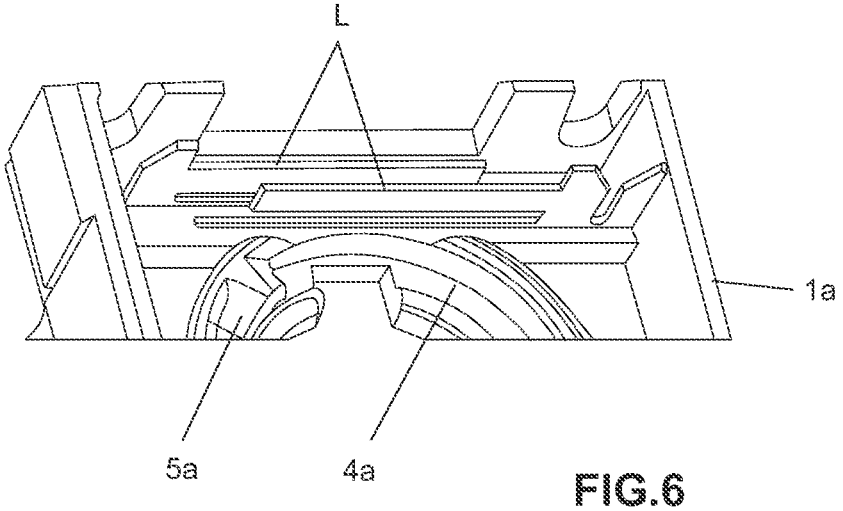
FIG. 6 illustrates a partial view of the structural base of the switch device, with detail showing the arrangement of the flexible contact blades, according to the present invention.

As illustrated in FIG. 6, according to a preferably advantageous embodiment of the present invention, the contact blades L are constituted by a two-part metallic plate, one of the segments of the plate being inserted into the slot 6 provided in the structural body 1*a*/1*b* and the other segment of the plate being arranged so as to remain free and has sufficient elasticity to return to the retracted position of the other blade L in the absence of action of forces. Logically, as must be appreciated by persons skilled in the art, one of the contact blades L, particularly that which does not enter into contact with the commutator ring 3, does not need to be flexible or two-part, and may be a metallic plate or a plate made of another material that conducts electricity which is rigid and with no partition.

With reference, again, to FIG. 2, it is observed that the upper structural body 1*b* has a format corresponding to the lower structural body 1*a* such that said bodies can engage and form the casing 1 of the switch device that is the subject of the present invention. More particularly, the upper structural body 1*b* comprises an aperture 7 through which the end of the rotary core 2 is positioned when the switch device is assembled.

Similar to the case of the lower structural body 1*a*, the upper structural body 1*b* also comprises a contact surface 4*b* provided with at least one projecting portion 5*b* that interacts with said commutator ring 3 engaged on said rotary core 2. More specifically, said rotary core 2 is positioned such that it can move rotationally in relation to the structural body 1*b* whenever the user rotates the equipment control.

The rotary core 2 is provided with a central aperture 8 for the passage of the gas tap shaft and, furthermore, comprises rails 9 for the orientation of guides 10 provided in the internal portion of said commutator ring 3. The purpose of these rails 9 is to allow said commutator ring 3 to move axially in accordance with its position in relation to the projecting portions 5*a*, 5*b* of the lower 1*a* and upper 1*b* structural bodies. More particularly, said commutator ring 3 comprises at least one upper protuberant portion 11 and at least one lower protuberant portion 11', which are designed to act on said projecting portions 5*a* and 5*b* of the respective structural bodies 1*a* and 1*b*.

Figure 1:
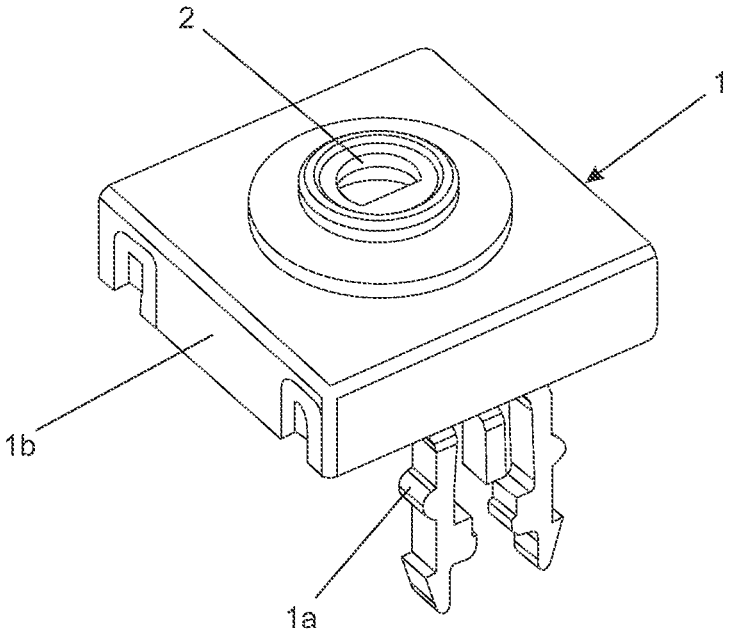
FIG. 1 illustrates a perspective view of the switch device for ignition systems of cooking and heating equipment according to the present invention, in the assembled condition.
Figure 2:
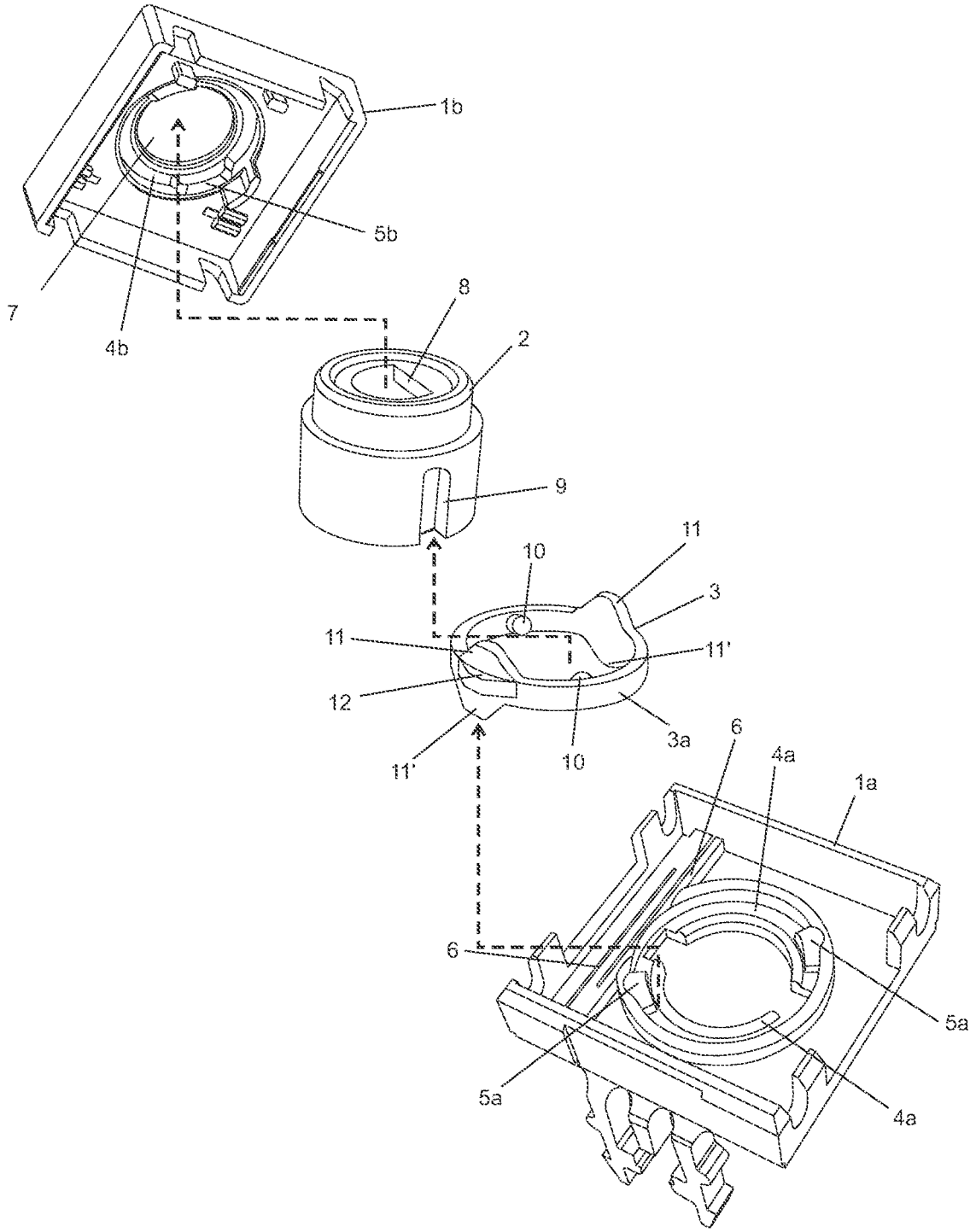
FIG. 2 illustrates the switch device that is the subject of the present invention in an expanded view, the assembly sequence being represented by the arrows and broken lines.
Figure 3A:
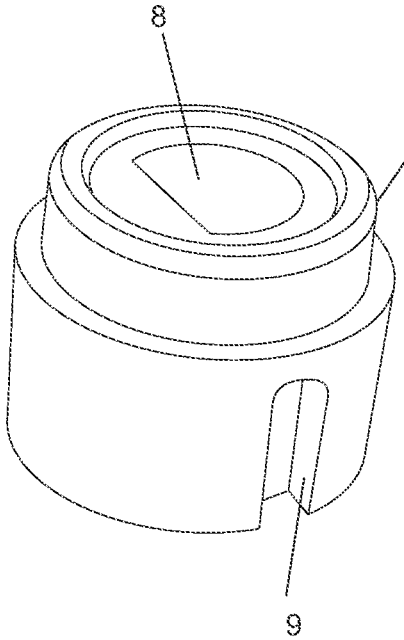
FIGS. 3A and 3B illustrate perspective views only of the rotary core of the switch device according to the present invention.
Figure 3B:
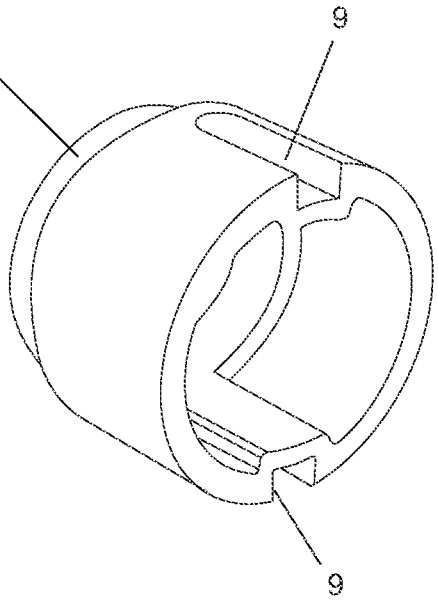
Figure 4:
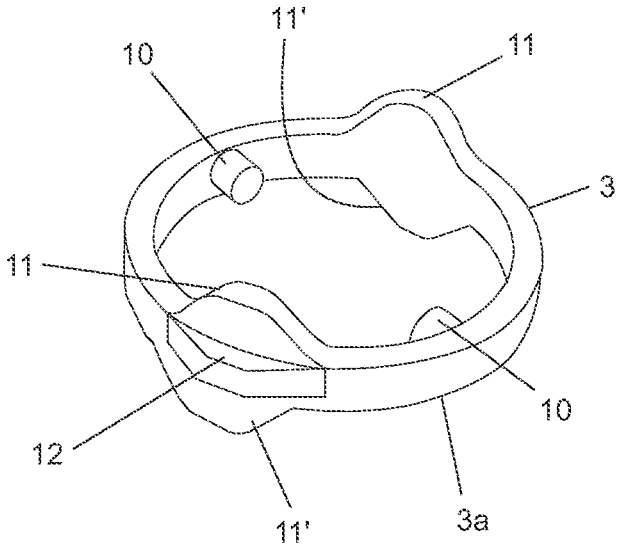
FIG. 4 illustrates a perspective view only of the commutator ring of the switch device according to the present invention.

FIGS. 3A and 3B illustrate a preferred embodiment of said rotary core 2, in which the rail 9 is provided on the walls to allow engagement and axial movement of said commutator ring 3, particularly via the guides 10 thereof arranged in the internal wall thereof. According to a possible alternative embodiment of the present invention, said rail 9 may be arranged vertically (as illustrated in the figures), but may also be on a slant.

Furthermore, as mentioned above, said rotary core 2 must comprise at least one rail 9 and said commutator ring must also comprise at least one guide 10 to act in conjunction with said rail 9. However, despite being functional with only one rail and one guide, according to a preferably advantageous embodiment and as illustrated by the appended figures the rotary core 2 comprises at least two rails 9 and the respective commutator ring 3 also has at least two guides 10, which guarantees alignment and avoids the risk of said ring 3 jamming in relation to the rotary core 2.

Figure 5:
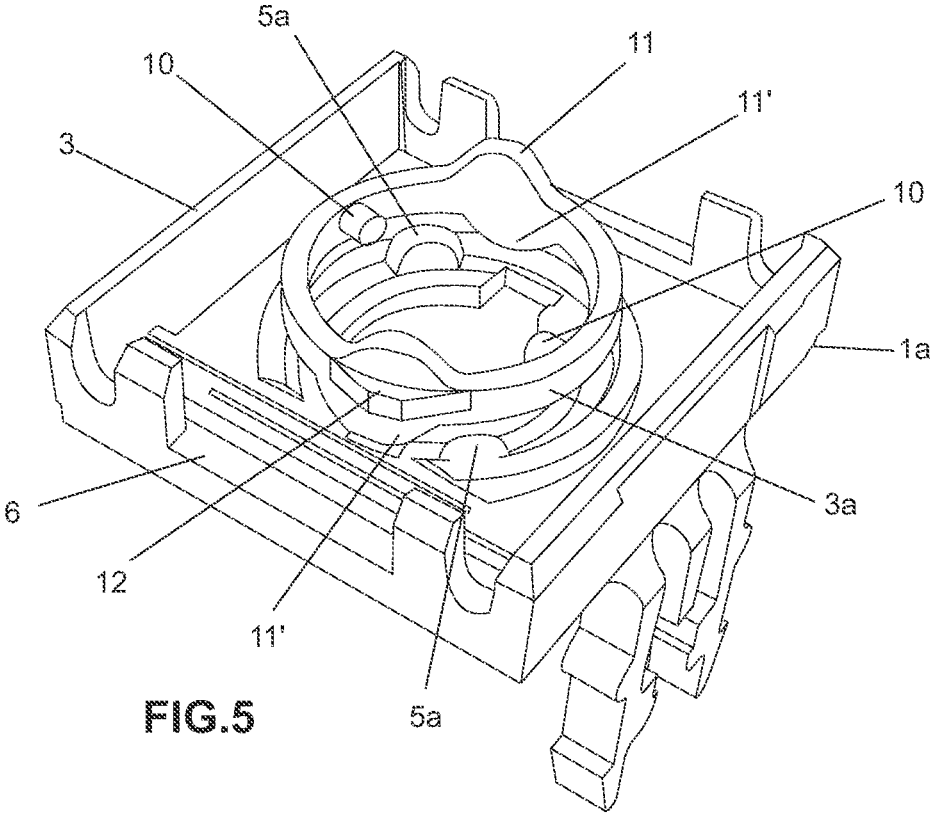
FIG. 5 illustrates a perspective view of the structural base and of the commutator ring of the switch device that is the subject of the present invention.

Reference is made to FIG. 5 which illustrates said commutator ring 3 merely positioned on the lower structural body 1*a*. In this figure, attention is drawn to the fact that the rotary core 2 has been omitted only to make it easier to see said commutator ring 3 and the contact surface 4*a*, especially in relation to the projecting portion 5*a*. More specifically, as may be seen, said commutator ring 3 rests on said contact surface 4*a* via the lower protuberant portions 11'. At the same time, and with reference, now, to FIG. 2, it is pointed out that said commutator ring 3 is aligned with the contact surface 4*b* of the structural body 1*b* and, more particularly, via the upper protuberant portions 11.

In addition, it is noted that said commutator ring 3 comprises a peripheral wall 3*a* that has a kind of cam 12, the purpose of which is to promote the activation of the electrical contacts and, more specifically, the aim of this cam 12 is to force the free segment of the contact blade L toward the other contact blade L in such a manner to obtain closure of the circuit and consequently generation of the spark for activating the burners. Thus, by virtue of the increase in circumference caused by the cam 12 over a specific portion of the commutator ring 3, when it passes via the region of the contact blades L it gives rise to the movement of the free segment of the contact blade against the other blade L, thereby closing the electrical contact of the ignition system.

It is pointed out that, when the control is returned to the turned-off position, the assembly and features of the switch device according to the present invention mean that said cam 12 is shifted axially, upward or downward, in relation to the free segment of the contact blade L and consequently does not generate any spark, since the blades do not lie against one another during the control return maneuver. This structure, and also the functioning of the present invention, will be described in greater detail and made clearer in the following description.

FIGS. 7A-7E and 8A-8E illustrate various views of the switch device according to the present invention from different angles and in the form of different cross sections, the aim being to illustrate as clearly as possible the assembly and, principally, the operation of the present invention and, more specifically, at the time of activation of the burners (FIG. 7) and at the time of the return movement of the control of the heating system equipment (FIG. 8).

As may be observed, FIGS. 7A to 7E illustrate the switch device of the present invention at the time when the user is rotating the equipment control in order to activate the ignition system and consequently to activate the burners. In this case, it will be seen that the rotary core 2, together with the commutator ring 3, is in such a position that the cam 12 is aligned with the free segment of the contact blade L and consequently, as the commutator ring 3 is rotated, the cam 12 thereof begins to push the free segment of the blade L aside toward the other flexible contact blade L.

Figure 7A:
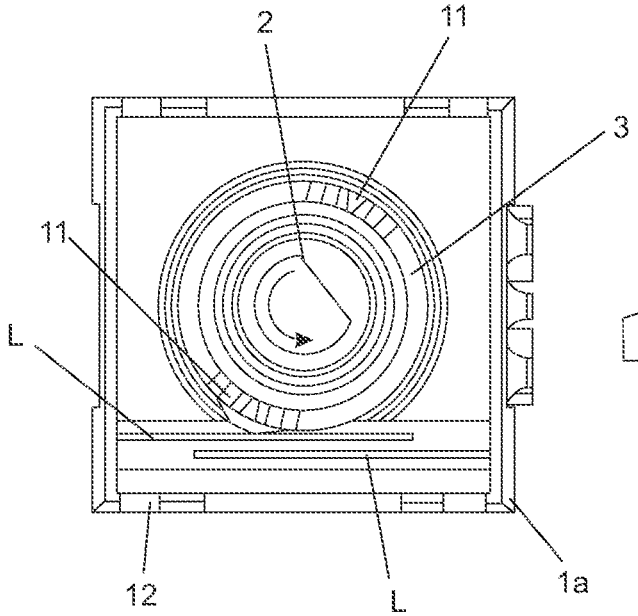
FIGS. 7A to 7E illustrate the switch device that is the subject of the present invention viewed from different angles in the situation in which the burners are activated.
Figure 7C:
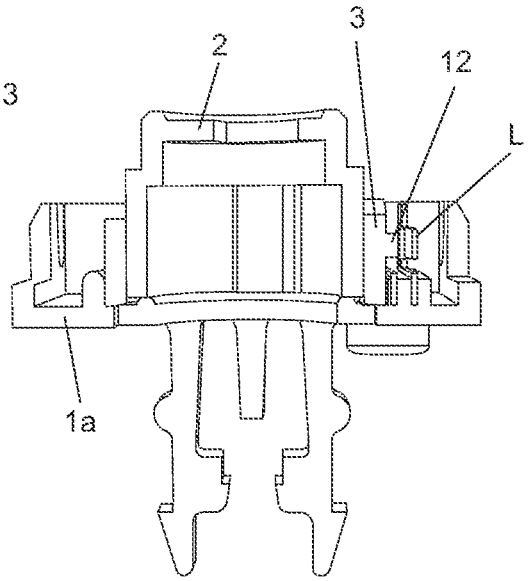
Figure 7B:
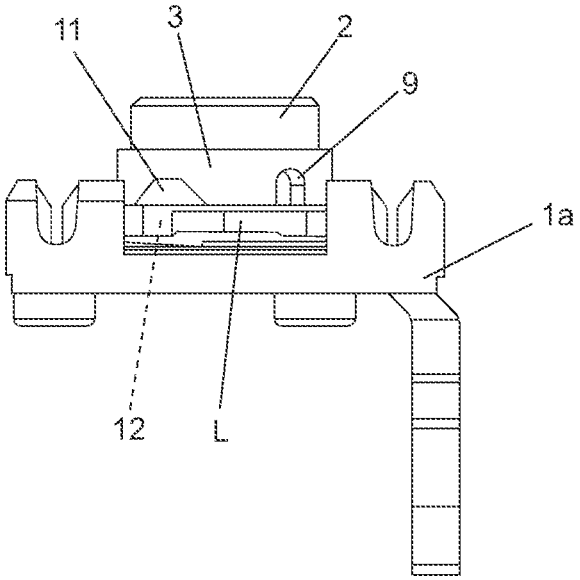
Figure 7D:
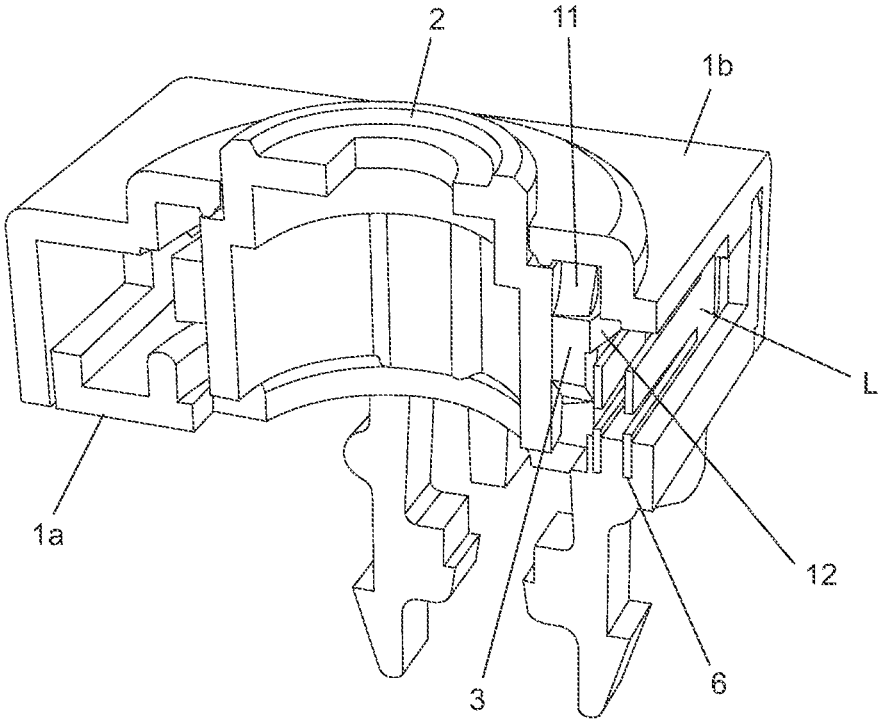
Figure 7E:
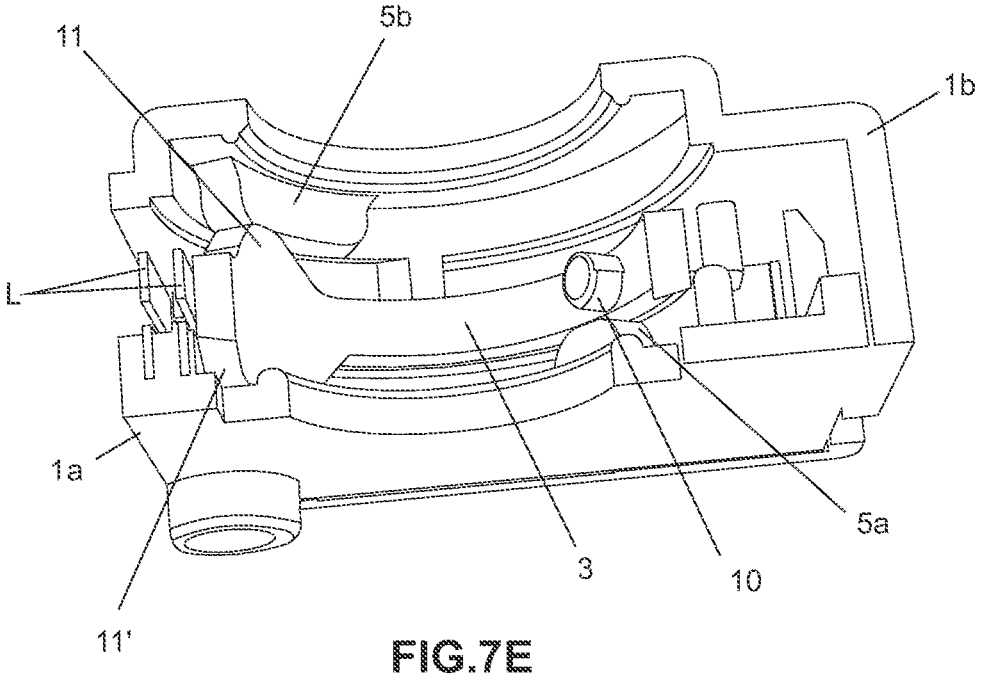

Particularly with reference to FIGS. 7D and 7E, it is possible to observe that, in the situation of the burners having been activated, the projecting portion 5*b* of the upper structural body 1*b* interacts with the upper protuberant portion 11 of the commutator ring 3, causing the guide 10 of the commutator ring 3 to be positioned in the lower portion of the rail 9 of the rotary core. In other words, the interaction between the projecting 5*b* and protuberant portion 11 ensure that the commutator ring 3 is positioned in the lower region of the rotary core 2, and consequently said cam 12 is at the same level as the contact blades L. Logically, as must be appreciated by persons skilled in the art, in an alternative embodiment of the present invention the guide 10 of the commutator ring 3 is positioned in the upper portion of the rail 9 of the rotary core 2 and, in this case, said contact blades are arranged in a more elevated configuration.

It should be made clear that, with this assembly and in this situation, it is possible to guarantee activation of the ignition system, thereby principally eliminating any risk of failure potentially caused by undesired axial movement of the commutator ring 3, since the cam 12 rests against the contact blades L, and there is also interaction between the protuberant portions 11 and 11' and the contact surfaces 4*a* and 4*b* of the structural bodies 1*a*/1*b* of the casing 1.

With reference, now, to FIGS. 8A to 8E, the switch device according to the present invention can be seen at the time when the user is moving the control of the cooking/heating equipment in the direction of return to the turned-off position, i.e. the rotary core 2 of the switch device is rotating in the opposite direction from that stated above with reference to FIGS. 7A to 7E.

In this case, it is noted that the rotary core 2, together with the commutator ring 3, is in the position in which the cam 12 is out of alignment in relation to the free segment of the contact blade L and consequently, as said commutator ring 3 is rotated, the cam 12 thereof does not make contact with said free segment of the blade L and therefore a blade is not pushed aside toward the other contact blade.

Figure 8A:
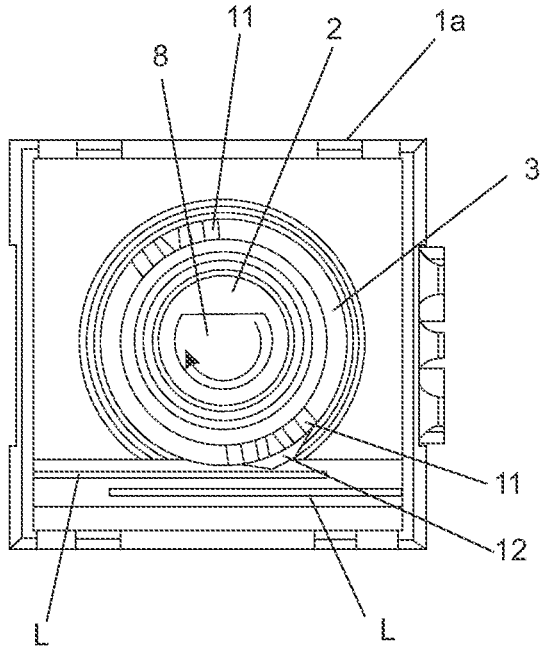
FIGS. 8A to 8E illustrate the switch device as illustrated in FIGS. 7A to 7E from different angles, but in the situation of the control having been returned to the turned-off position.
Figure 8C:
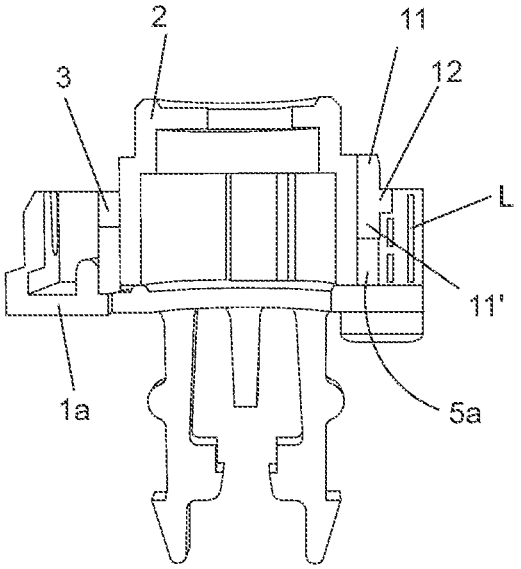
Figure 8B:
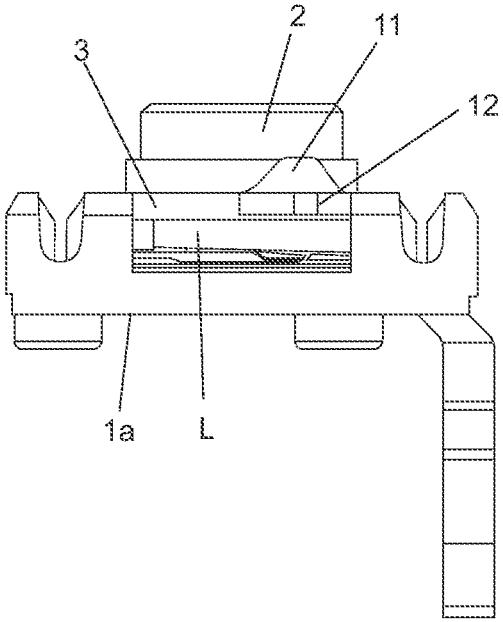
Figure 8D:
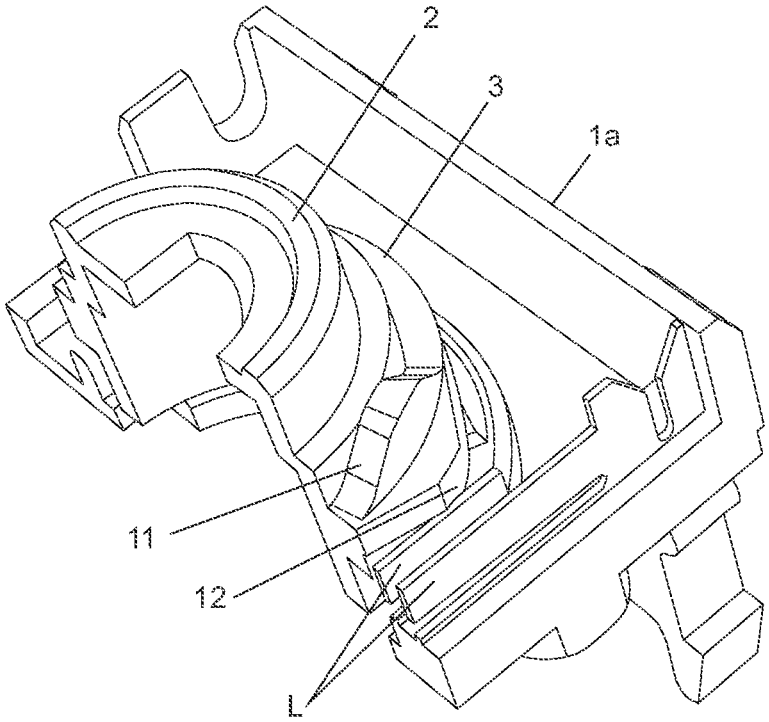
Figure 8E:
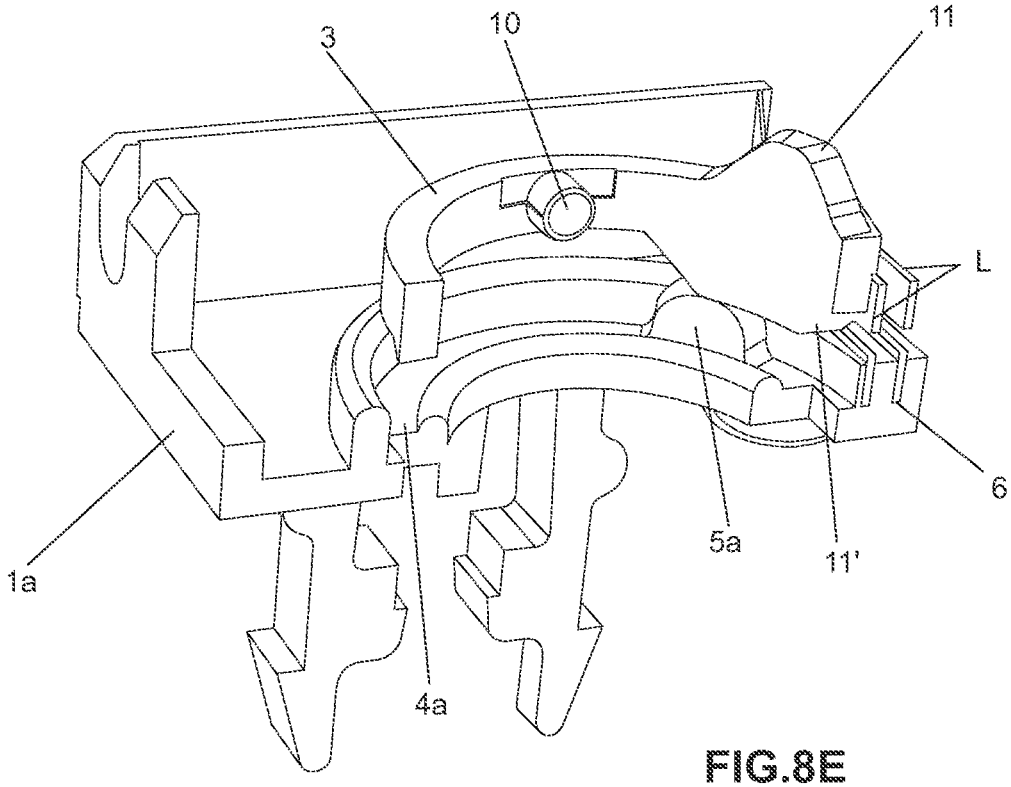

With particular reference to FIGS. 8D and 8E, it is noted that, in this condition of return of the control to the turned-off position, the projecting portion 5*a* of the lower structural body 1*a* interacts with the lower protuberant portion 11' of the commutator ring 3 such that said guide 10 of the ring 3 is arranged in the upper region of the rail 9 of the rotary core 2 or, alternatively, in the lower portion of the rail 9, depending on the positioning of said contact blades L. More specifically, it is noted that the interaction between the projecting portion 5*a* and protuberant portion 11' ensures that the commutator ring 3 is positioned in the upper region of the rotary core 2 and thus said cam 12 moves over the contact blades L, i.e. the cam 12 passes above the flexible contact blade L. According to the alternative embodiment of the present invention, the interaction between the projecting 5*b* and protuberant 11 portions guarantees that the commutator ring 3 is positioned in the lower region of the rotary core 2 and thus said cam 12 moves below the contact blades L, i.e. the cam 12 passes below the flexible contact blade L.

By virtue of this assembly, it is possible to ensure that said flexible contact blades L do not lie against one another and consequently it is guaranteed that there will be no generation of the so-called "return sparks". This is possible because, once again, said commutator ring 3 rests on the contact blades and thus movement of said commutator ring 3 in the axial direction and consequently of the contact blades L is prevented. Thus, the cam 12 is successfully prevented from unintentionally or undesirably moving the contact blades L at the time when the control is returning to the turned-off position.

Lastly, taking all the aforesaid into consideration, it is important to point out that the present description is aimed only at describing preferred embodiments of the ignition system switch device according to the present invention in an illustrative manner. Thus, as persons skilled in the art well understand, numerous structural modifications, variations and combinations of the elements having the same functions substantially in the same form in order to achieve the same results are possible and these should be included within the scope of protection defined by the appended claims.

The invention claimed is:

1. A switch device for an ignition system, the switch device comprising:

a casing including a lower structural body and an upper structural body, which engage with one another;

flexible contact blades and a rotary core, wherein the flexible contact blades and the rotary core are accommodated within the casing; and an axially moveable commutator ring engaged on said rotary core, wherein:

the lower structural body has a contact surface provided with at least one projecting portion, the upper structural body has a contact surface provided with at least one projecting portion, said flexible contact blades are made from metallic material or another material that conducts electricity, and the switch device for an ignition system is configured such that the rotary core is axially stationary.

2. The switch device for an ignition system of claim 1, wherein said contact blades are formed by two-part plates.

3. The switch device for an ignition system of claim 1, wherein said commutator ring comprises at least one upper protuberant portion and at least one lower protuberant portion that respectively interact with the upper structural body and the lower structural body.

4. The switch device for an ignition system of claim 1, wherein the at least one projecting portion of the contact surface of the lower structural body and the at least one projecting portion of the contact surface of the upper structural body are components spaced away from respective centers of the lower structural body and the upper structural body.

5. The switch device for an ignition system of claim 1, wherein the rotary core comprises at least two rails, and the commutator ring has at least two guides.

6. The switch device for an ignition system of claim 1, wherein the rotary core comprises at least two grooves, and the commutator ring has at least two protrusions respectively extending into the grooves of the at least two grooves.

7. The switch device for an ignition system of claim 5, wherein the guides and rails fit relative to one another in a male-female relationship.

8. The switch device for an ignition system of claim 5, wherein said commutator ring comprises at least one upper protuberant portion and at least one lower protuberant portion that respectively interact with the upper structural body and the lower structural body.

9. The switch device for an ignition system of claim 3, wherein the commutator ring further comprises a protruding member extending away from an axial direction of the commutator ring, and the protuberant portions extend in the axial direction, and wherein the protruding member moves, when the commutator ring is rotated, over the contact blades, and wherein the switch device is configured such that when the switch device is returned from a turned-on positon to a turned off-position, the protruding member is shifted in the axial direction, upward or downward, in relation to a free segment of a contact blade of the flexible contact blades and thus does not generate any spark, because the switch device is configured such that the blades do not lie against one another during the return maneuver.

10. The switch device for an ignition system of claim 6, wherein the rotary core includes a central aperture configured to enable passage of a gas tap shaft.

11. The switch device for an ignition system of claim 6, wherein the rotary core includes a central aperture through which extends a gas tap shaft.

12. A switch device for an ignition system, the switch device comprising:

a casing including a lower structural body and an upper structural body, which engage with one another;

flexible contact blades and a rotary core, wherein the flexible contact blades and the rotary core are accommodated within the casing; and an axially moveable commutator ring engaged on said rotary core, wherein:

the lower structural body has a contact surface provided with at least one projecting portion, the upper structural body has a contact surface provided with at least one projecting portion, said rotary core comprises a central aperture for a passage of a gas tap shaft, and rails where guides provided in an internal portion of said commutator ring are engaged, and said commutator ring comprises at least one upper protuberant portion and at least one lower protuberant portion that respectively interact with the upper structural body and the lower structural body.

13. The switch device for an ignition system of claim 12, wherein at least one rail of the rails is arranged vertically or on a slant.

14. A switch device for an ignition system, the switch device comprising:

a casing including a lower structural body and an upper structural body, which engage with one another, flexible contact blades and a rotary core, wherein the flexible contact blades and the rotary core are accommodated within the casing; and an axially moveable commutator ring engaged on said rotary core, wherein:

the lower structural body has a contact surface provided with at least one projecting portion, the upper structural body has a contact surface provided with at least one projecting portion, the projecting portions interact with the commutator ring, the commutator ring comprises at least one upper protuberant portion and at least one lower protuberant portion, and the commutator ring rests on one of the contact surfaces via the lower protuberant portion and is aligned with the other of the contact surfaces via the upper protuberant portion.

15. The switch device for an ignition system of claim 14, wherein said flexible contact blades are made from metallic material or another material that conducts electricity.

16. The switch device for an ignition system of claim 14, wherein said rotary core comprises a central aperture for a passage of a gas tap shaft, and rails where guides provided in an internal portion of said commutator ring are engaged to enable the commutator ring to move in a direction parallel to an axis of the rotary core.

17. The switch device for an ignition system of claim 14, wherein said lower structural body includes an aperture, and a component forming a portion of the aperture establishes the contact surface of the lower structural body.

18. The switch device for an ignition system of claim 14, wherein the lower structural body has a second contact surface separate and distinct from the contact surface provided with the at least one projecting portion, and the second contact surface includes at least one second projecting portion.

19. The switch device for an ignition system of claim 14, wherein said flexible contact blades are arranged in slots provided in said lower structural body, in said upper structural body, or in both structural bodies.

20. The switch device for an ignition system of claim 15, wherein the switch device for an ignition system is configured such that the rotary core is axially stationary.

21. The switch device for an ignition system of claim 15, wherein the switch device for an ignition system is configured such that lateral positions of the rotary core are entirely maintained relative to the rest of the switch device for an ignition system by components on an outside of the rotary core.

22. The switch device for an ignition system of claim 15, wherein the rotary core includes a central aperture, and wherein the switch device for an ignition system is configured to enable passage of a gas tap shaft through the central aperture.

23. A switch device for an ignition system, the switch device comprising:

a casing including a lower structural body and an upper structural body, which engage with one another;

flexible contact blades and a rotary core, wherein the flexible contact blades and the rotary core are accommodated within the casing; and an axially moveable commutator ring engaged on said rotary core, wherein:

the lower structural body has a contact surface provided with at least one projecting portion, the upper structural body has a contact surface provided with at least one projecting portion, the at least one projecting portion of the contact surface of the lower structural body and the at least one projecting portion of the contact surface of the upper structural body are entirely within a cavity formed by a union of the lower structural body and the upper structural body, said flexible contact blades are made from metallic material or another material that conducts electricity, and the switch device for an ignition system is configured such that the rotary core is axially stationary.

* * * * *